US005441628A

United States Patent [19]

Tasaki et al.

[11] Patent Number: 5,441,628

[45] Date of Patent: Aug. 15, 1995

[54] METHOD FOR PREPARATION FOR A ZN-NI ELECTROPLATING OR HOT-DIP GALVANIZING BATH USING A ZN-NI ALLOY, AND METHOD FOR PRODUCING A ZN-NI ALLOY

[75] Inventors: Hiroshi Tasaki; Eiji Nishimura, both of Saitama, Japan

[73] Assignee: Japan Energy Corporation, Tokyo, Japan

[21] Appl. No.: 202,173

[22] Filed: Feb. 25, 1994

Related U.S. Application Data

[62] Division of Ser. No. 944,920, Sep. 15, 1992, Pat. No. 5,336,392.

[51] Int. Cl.[6] ..... C25D 21/18

[52] U.S. Cl. ..... 205/101; 205/246

[58] Field of Search ..... 204/246, 245, 101

[56] References Cited

U.S. PATENT DOCUMENTS 4,923,573 5/1990 Florian ..... 204/44.2

FOREIGN PATENT DOCUMENTS 60-248855 12/1985 Japan .
2282435 11/1990 Japan .
379732 4/1991 Japan .

OTHER PUBLICATIONS

Lowenheim, "Electroplating", McGraw-Hill Book Co., 1979, pp. 152-154.

*Primary Examiner*—Kathryn Gorgos
*Assistant Examiner*—Kishor Mayekar
*Attorney, Agent, or Firm*—Birch, Stewart, Kolasch & Birch

[57] ABSTRACT

A Zn-Ni alloy having a high Ni content is used for supplying $Ni^{2+}$ and $Zn^{2+}$ ions into an acidic plating bath and for supplying Ni and Zn into a hot dip galvanizing bath. This alloy is characterized by being produced by using a flux consisting of a fused-salt former, which forms a salt having a melting temperature of 700° C. or less, and $Na_2B_4O_7$ and occasionaly additionally $Na_2CO_3$. By using the inventive alloy, the bath can be quickly prepared, and Zn and Ni can be supplied to the bath without leaving the undissolved residue.

4 Claims, 1 Drawing Sheet

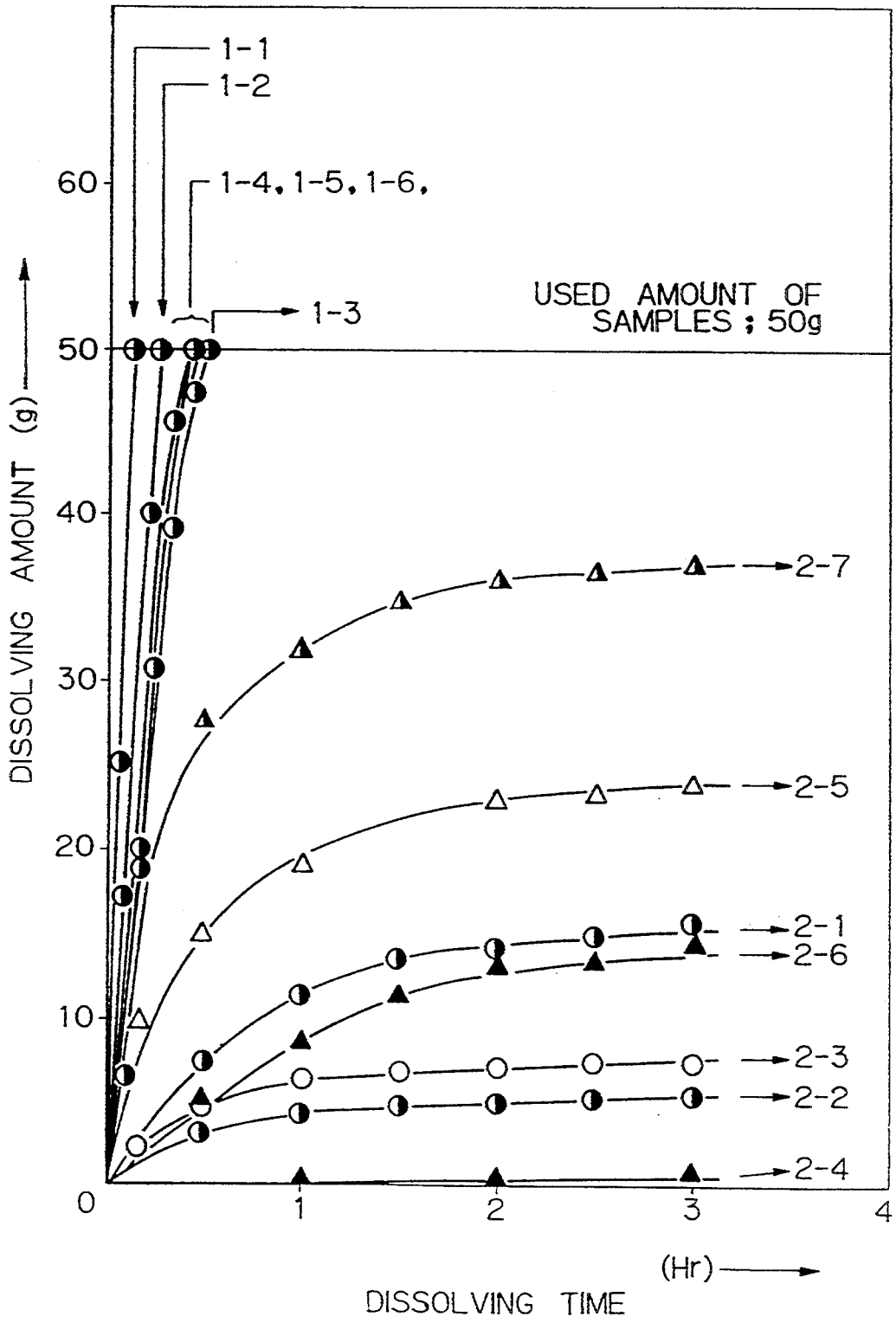
1-1
1-2
1-4, 1-5, 1-6,
1-3
USED AMOUNT OF SAMPLES ; 50g
2-7
2-5
2-1
2-6
2-3
2-2
2-4
DISSOLVING AMOUNT (g)
0
10
20
30
40
50
60
1
2
3
4
(Hr)
DISSOLVING TIME

METHOD FOR PREPARATION FOR A ZN-NI ELECTROPLATING OR HOT-DIP GALVANIZING BATH USING A ZN-NI ALLOY, AND METHOD FOR PRODUCING A ZN-NI ALLOY

This application is a divisional of copending application Ser. No. 07/944,920, filed on Sep. 15, 1992, now U.S. Pat. No. 5,336,342, the entire contents of which are hereby incorporated by reference.

BACKGROUND OF INVENTION

1. Field of the Invention

The present invention is related a method for preparation of a Zn-Ni alloy electroplating bath using a Zn-Ni alloy. Such an alloy is used, for example, for simultaneously dissolving Zn and Ni into a Zn-Ni electroplating bath, which, in turn, is used for continuously producing a Zn-Ni electroplated steel sheet by utilizing an insoluble anode. In addition, the present invention is related to a method for simultaneously dissolving Zn and Ni into a Zn-Ni hot-dip galvanizing bath. Furthermore, the present invention is related to a method for producing a Zn-Ni alloy.

2. Description of Related Arts

There are two methods for supplying metals into an acidic Ni-Zn electroplating bath using an insoluble anode.

(1) A method for supplying the metals into the plating bath by means of dissolving the metals in the form of a soluble salt, such as a basic carbonate.

(2) A method for supplying the metals into the plating bath by means of separately bringing the plating metals, i.e., Ni and Zn, into direct contact with the acid of the plating bath.

Method (1) is superior to the Method (2) with respect to dissolving performance. Method (1) is, however, inferior to Method (2) in cost. Method (2) is cost-effective but its poor dissolving performance is a disadvantage.

Dissolving Ni and Zn in the acidic solution by Method (2) involves a cathodic reaction $2H^+ + 2e = H_2$. However, since the hydrogen overvoltage of zinc is high and this makes it for the above reaction to take place. This seems to be a reason for the poor dissolving performance of the method (2). Particularly, the Zn dissolving performance is impaired also by $Ni^{2+}$ ions present in the acidic plating bath, because $Ni^{2+}$ ions replace for Zn the metallic Zn and then precipitate on the metallic surface. The metallic Zn is therefore covered with the Ni, so that the dissolving of Zn is impeded.

Under the circumstances of the prior technique described above, prior art does not simultaneously dissolve the metallic Zn and Ni from the same source.

Japanese Unexamined Patent Publication No. 60-248855 discloses a Zn-Ni alloy, with 3% or less of Ni, used for preparation of a hot-dip galvanizing bath. This publication describes that a Zn-Ni alloy with a higher Ni content causes vigorous vaporization of Zn as the Zn-Ni alloy is dissolved, and more Ni is transferred into dross than when Zn-Ni alloy with less than 3% of Ni is dissolved. Incidentally, the zinc metal is melted and then Ni is added to the molten Zn so as to provide an alloy having a predetermined composition.

The following methods are known heretofore for producing a Zn-Ni alloy.

(1) Metallic Zn and metallic Ni are melted to produce a Zn-Ni alloy.

(2) Ni salt, for example, nickel chloride, is added to the metallic Zn.

Zn-Ni alloy with 2 wt % or less of Ni has a melting point of approximately 600° C. Such Zn-Ni alloy can therefore be melted without relying on a flux. However, since the melting point is greately raised when the Ni content is higher than 2 wt % according to a phase diagram, the melting temperature of Zn-Ni alloy exceeds the temperature where vigorous vaporization of Zn occurs. It is therefore extremely difficult to produce a Zn-Ni alloy by melting. More specifically, when the surface temperature of Zn-Ni bath exceeds 750° C., the Zn vigorously vaporizes and is oxidized. As a result, an ignition and combustion phenomenon occurs. In addition, bumping phenomenon of the Zn-Ni bath may occur. For the reasons described above, it is recognized that production of Zn-high Ni alloy is difficult by Method (1).

In Method (2) also, a high temperature is necessary for producing a Zn-Ni alloy. In addition, since nickel chloride, which is expensive, is used in Method (2), this Method is not advisable.

SUMMARY OF THE INVENTION

It is a first object of the present invention to provide an economical preparation of an acidic plating bath by using a Zn-Ni alloy and to improve the dissolving performance of mother materials for such preparation.

In accordance with the first object, there is a method for supplying $Ni^{2+}$ and $Zn^{2+}$ ions into an acidic Zn-Ni alloy plating bath, said alloy having a particle diameter of 1 mm or less and having a composition containing from 2 to 50% by weight of Ni, the balance being essentially Zn.

There is also provided a Zn-Ni alloy to be used for the preparation of the acidic plating bath, containing from 10 to 30% of Ni.

It is a second object of the present invention to provide a method for preparation of a hot dip galvanizing plating bath by using a Zn-Ni alloy, so that: (1) for a short period of time, a bath having a desired Ni content can be made up or replenished with Ni due to a high Ni content of the alloy; and (2) virtually all of the Zn-Ni alloy can be melted in the hot-dip galvanizing bath.

In accordance with the second object, there is provided a method for supplying Ni and Zn into a hot-dip galvanizing bath by using a Zn-Ni alloy, said alloy having a composition containing from 4 to 50% by weight of Ni, the balance being essentially Zn, and being produced by using a flux consisting of a fused salt former for forming a salt having a melting temperature of 700° C. or less and $Na_2B_4O_7$, and occasionally further containing $Na_2CO_3$. There is also provided a Zn-Ni alloy to be used for the preparation of the hot-dip galvanizing bath, containing from 10 to 30% of Ni.

It is a third object of the present invention to provide a method for producing a Zn-Ni alloy having a high Ni content, which method can solve the operational problems of Zn vaporization and oxidation reaction, and which can avoid the bumping of the Zn-Ni alloy bath. It is also a third object to provide a Zn-Ni alloy which exhibit improved dissolving characteristics in the acidic plating bath and hot-dip galvanizing bath and generates only a small amount of dross when melting in the hot-dip galvanizing bath.

In accordance with the third object, there is provided a method for producing a Zn-Ni alloy, characterized in that said alloy has a composition containing from 2 to 50% by weight of Ni, the balance being essentially Zn, and which is melted by using a flux consisting of a fused salt-former for forming a salt having a melting temperature of 700° C. or less and $Na_2B_4O_7$ and optionally further containing $Na_2CO_3$. There is also provided a method for producing a Zn-Ni alloy, wherein said alloy has a composition containing from 2 to 50% by weight of Ni, the balance being essentially Zn, and said alloy is melted by using a flux consisting of a salt former for forming a salt having a melting temperature of 700° C. or less, said means consisting of from 30 to 70% by weight of NaCl and KCl in balance, from 10 to 100% by weight of $Na_2B_4O_7$ and/or $Na_2CO_3$ in balance. The NaCl-KCl binary composition is contained in the flux at a proportion of from 3 to 20% by weight.

DESCRIPTION OF PREFERRED EMBODIMENTS

In the first aspect of the present invention a Zn-Ni alloy is used as raw material for preparation of an acidic Zn-Ni plating bath. Purest zinc, electric zinc (99.99% Zn) or distilled zinc (98.5% Zn) can be used as the zinc metal. Ni metal having 99.5% more of Ni-purity can be used. When supplying the $Ni^{2+}$ and $Zn^{2+}$ ions into the acidic Zn-Ni alloy plating bath and preparing this bath by the Zn-Ni alloy, the following characterizing dissolving phenomenon is realized. Since Zn is alloyed with Ni, the hydrogen overvoltage is relatively lowered. In the acidic bath, Zn is first preferentially dissolved. Very fine Ni and Ni-Zn intermetallic compounds are then left in the Zn-Ni alloy, with the result that its surface area is greatly increased. The Ni solution is thus so promoted that the entire amount of Zn-Ni alloy can be dissolved in a short period of time. It is therefore possible to simultaneously supply $Ni^{2+}$ and $Zn^{2+}$ ions into the acidic Zn-Ni alloy plating bath. The above described dissolving phenomenon occurs likewise in the Zn-Ni alloy likewise in the compositional range of from 2 to 50% by weight.

The Zn-Ni alloy to be used in the present invention must have a maximum Ni content of 50% by weight, because a high-grade material having a Ni content greater than 50% is difficult to produce by melting due to its high melting point. In addition, when the Ni content is high, the surface area of Ni, which is left after the preferential dissolution of Zn, is so decreased that the dissolving speed of Ni is lowered. The Zn-Ni alloy to be used in the present invention must contain at least 2% of Ni, because a Zn-Ni alloy having a lower grade of Ni is not practical for the dissolving preparation of an electroplating bath, which usually has an Ni concentration of from 25 to 100 g/l.

A preferred composition of Zn-Ni alloy used for the preparation of a bath for Zn-Ni electroplating is from 10 to 30% of Ni, the balance being Zn.

Another characteristic of the alloy according to the present invention is that its particle diameter is 1 mm or less. Usually, the $Ni^{2+}$ and $Zn^{2+}$ concentrations in the acidic Zn-Ni alloy plating bath are from 25 to 100 g/l, for both ions. When a Zn-Ni alloy is dissolved in this acidic Zn-Ni alloy plating bath, the $Ni^{2+}$ ions in the plating bath replace the metallic Zn and precipitate on the surface of the Zn-Ni alloy, as metallic Ni. This is the so-called cementation phenomenon. When the particle diameter of the ZnNi alloy is greater than 1 mm, its solution speed is lowered due to the cementation reaction. Contrary to this, when the particle diameter of the Zn-Ni alloy is 1 mm or less, the solution speed is not lowered but is promoted. The particle diameter may be adjusted by any one of the crushing and atomizing methods.

As is well known, the Zn-Ni alloy plating bath is acidic and is mainly composed of $H_2SO_4$, HCl or the like. When acidity of the plating bath is lower, the solution of Zn-Ni alloy is carried out more preferably. However, when the pH is excessively low, such disadvantages as reduction in current efficiency of the Zn-Ni alloy plating may arise. Preferable pH is therefore from 0.8 to 3.0.

A Zn-Ni alloy can be more advantageously dissolved at a higher temperature of the plating bath. However, a satisfactory high solution speed can be attained at electro-plating bath temperature of from 50° to 60° C.

In order to prepare the hot-dip galvanizing bath according to the second aspect of the present invention, a Zn-Ni alloy having a composition containing from 4 to 50% by weight of Ni, the balance being essentially Zn, is preliminarily melted by using a flux consisting of a fused-salt former for forming a salt having a melting temperature of 700° C. or less and $Na_2B_4O_7$ and optionally further containing $Na_2CO_3$. The so-produced alloy is then dissolved in the molten bath. The so-produced Zn-Ni alloy has a high Ni content, contains Ni uniformly distributed therein, and has a melting point which is virtually the same that given in a phase diagram. This alloy can therefore be melted at such temperature while not incurring the disadvantages of the Zn-Ni alloy produced by the conventional method. Even if the Zn-Ni alloy having the inventive composition could be produced by the conventional method, at the sacrifice of yield, Ni, which has a high melting point, greatly segregates, so that much of the Ni is left as undissolved residue when such alloy is dissolved. Since the present invention does not involve such disadvantages, addition of Ni to the molten bath is very easy.

Particle size of the alloy to be used in the second aspect of the present invention is not at all limited but is practically 20 mm or less. When the particle size is too small, the alloy floats on the surface of the plating bath. The particle size is preferably 1 mm or more.

Subsequently, the method for producing the Zn-Ni alloy according to the present invention is described in detail and more specifically so as to facilitate the understanding of the method.

The method according to the present invention involves a discovery that a certain composition of flux can prevent, during melting production of a Zn-Ni alloy having 2 weight % or more at high temperature, oxidation of the Zn-Ni alloy on its surface and zinc vaporization, as well as ignition and combustion of the zinc-nickel bath. The flux consists, as described above, of a fused-salt former having a melting point of 700° C. or less, and $Na_2B_4O_7$. $Na_2CO_3$ can optionally be added. For example, NaCl and KCl can be used as the fused-salt former having a melting point of 700° C. or less. The NaCl content is preferably from 30 to 70% by weight. Because the melting point of the NaCl-KCl is 700° C. or less, ignition of the vaporizing Zn can be prevented, and advantageous fluxing effects are attained for melting the Zn-Ni alloy. Proportion of $Na_2B_4O_7$ and $Na_2CO_3$ is preferably from 10–100 wt % and 90–0 wt %, because the binary $Na_2B_4O_7$-$Na_2CO_3$ melts at a temperature of 800° C. or more and easily absorbs such oxides as ZnO and NiO. When the proportion of $Na_2B_4O_7$ and $Na_2CO_3$ is as described above, the NaCl-KCl composition is preferably contained in the flux at a content of from 3 to 20 wt %, because the ignition of vaporizing Zn can effectively be prevented during the temperature elevation of the zinc metal.

In the melting, zinc is first melted down, and then nickel is added to the molten zinc. The flux described above is dispersed on the molten zinc. The fused-salt former having a melting point of 700° C. or less, e.g., NaCl and KCl, first melts at approximately 650° C., and covers the surface of the molten bath to shield it from contact with air. Neither vaporization of Zn resulting in Zn loss, nor ignition and combustion of the Zn vapor therefore occur.

The fused-salt former having a melting point of 700° C. or less, e.g., NaCl and KCl, does not absorb therein such oxides as ZnO and NiO formed in small amounts on the surface of Zn-Ni bath. These oxides therefore are present as solids in the interface between the fused salt and the molten alloy.

If the flux consists only of NaCl and KCl, and when the alloy melt is heated to a temperature higher than 800° C., the amount of the oxides is so increased that it becomes difficult for the flux in a molten state to cover the surface of Zn-Ni bath. Such a flux no longer exhibits the effect of shielding the molten alloy from contact with air. Zn then actively vaporizes, leading to ignition and burning of Zn. Contrary to this, in the present invention, when the temperature of the metal bath, which is covered with NaCl-KCl, one of the components of the flux according to the present invention, is further heated to approximately 800° C., then the $Na_2B_4O_7$ or $Na_2B_4O_7$ and $Na_2CO_3$ are caused to melt. Such oxides as ZnO and NiO are absorbed in or dissolve in the resultant $Na_2B_4O_7$ or $Na_2B_4O_7$ and $Na_2CO_3$ fused salt. As a result, the surface of the Zn-Ni alloy melt is covered by the fused salt of NaCl-KCl and the fused salt of $Na_2B_4O_7$-$Na_2CO_3$. These fused salts stably cover the surface of the Zn-Ni alloy melt up to a temperature of approximately 1300° C. Their vapor pressure is so low as not to incur loss of the fused salts.

According to the method of the present invention with the use of flux as described above, the oxides of Zn and Ni formed due to high-temperature oxidation are absorbed by the flux, while the vaporization of metallic Zn is suppressed. The alloy melt is protected from contact with air, so that neither ignition nor combustion of the alloy melt occurs. Because the above advantages are attained, it is possible to stably produce Zn alloy having a high Ni content under high temperature. The Ni content is preferably from 2 to 50wt %, because at a Ni content less than 2% the alloy has such a low melting point that it can be produced by any method other than the present invention, and at a Ni content more than 50%, the melting point is so high as to make production by the present method impossible.

Several features of the method for producing a Zn-Ni alloy according to the present invention are further described.

Nickel is added to the Zn bath until the predetermined Ni grade is attained. Preferably, Ni grade of the Zn bath is gradually increased, and the temperature of the alloy melt is elevated with the increase in the Ni content. Contrary to this, if the entire amount of Ni is added at once to the Zn bath, followed by abrupt temperature-elevation, the temperature of the alloy bath suddenly becomes higher than the boiling point of Zn, i.e., 906° C., when the Ni metal reacts with zinc melt and hence imparts heat to the melt due to exothermic reaction of alloying. As a result, bumping arises. This then leads to ignition and combustion of Zn. When the nickel is gradually added to the Zn bath, the temperature of the bath is raised in accordance with the increase in Ni content The melting temperature can be raised upto 1100° C., which exceeds the boiling point of Zn.

The present invention is further described by way of examples.

BRIEF DESCRIPTION OF DRAWING

The FIGURE illustrates the melting speed in the various dissolving methods.

EXAMPLES

Example 1

In this example, 6 kg of Zn-50% Ni alloy was melted.

First 3 kg of Zn (99.99 wt % Zn) was weighed, charged in a crucible, heated and melted.

NaCl (50 g), KCl (50 g), $Na_2B_4O_6$ (250 g) and $Na_2CO_3$ (650 g) were mixed in a mortar to provide a flux. The flux, weighing approximately 100 g, was dispersed on the surface of molten Zn bath, when temperature of this bath was elevated to approximately 450° C. The temperature of the molten bath was further increased. When the temperature was increased up to 650° C., the mixed salts of NaCl and KCl were first melted and covered the surface of molten Zn bath. At this stage the mixed salts of $Na_2B_4O_7$ and $Na_2CO_3$ were in a half molten state.

When the temperature of the molten Zn bath was further increased up to 700° C., 62.5 g of shot Ni (99.5 wt %) was added to the molten Zn bath and was totally dissolved. The nominal Ni content became therefore 2 wt %. The temperature of the molten Zn-Ni alloy bath was further increased up to 850° C. 62.5 g of shot Ni was further added to the alloy melt and was totally dissolved. The nominal Ni content became therefore 4 wt %. Likewise, the temperature of the molten Zn-Ni alloy was increased higher than the melting point of such alloy by 50°–100° C., and, then 62.5 g of shot Ni was added. Finally, temperature of the molten Zn-Ni alloy was increased to 1000° C., which exceeded the boiling point of Zn, and 3 kg of Ni was totally dissolved. The nominal composition became Zn-50% Ni. The mixed salts of $Na_2B_4O_7$ and $Na_2CO_3$ were melted at approximately 800° C. At this temperature, the mixed, fused salts of NaCl, KCl, $Na_2B_4O_7$ and $Na_2CO_3$ were formed and covered the surface of the molten Zn-Ni alloy. Same amounts of ZnO and NiO, which were formed somewhat, were absorbed by the flux. Neither loss of Zn nor combustion of Zn vapor was detected.

The so-produced Zn-50% Ni alloy melt was cast into a mold, and the cast alloy was produced. A product, whose size is the same as the mold, was produced.

In addition, molten Zn-50 wt % Ni alloy was dropped into water. As a result, a spheroidal alloy shot having various shapes could be produced.

The cast product was crushed by a vibrating mill. As a result, crushed product having particle diameter of under 325 mesh (43 μm) was obtained. The Ni content of the cast product was 49.9%. The balance was Zn.

Example 2

A Zn-13 wt % Ni alloy was produced by melting 3 kg of Zn and 448 g of Ni. In the present example, the melting temperature was elevated, while adding Ni into the Zn melt, as in Example 1 until the melt temperature of 950° C., which exceeds the boiling point of Zn, was finally obtained.

The Zn-13 wt % Ni alloy could be cast into the same shape as a mold. In addition, alloy shot having a variable size could be produced by dropping the melt of this alloy into water. The particle size of under 325 mesh (43 μm) could be obtained by crushing. The Ni content of the cast product was 12.85 wt %, the balance being Zn.

Example 3

A Zn-4 wt % Ni alloy was produced by melting 3 kg of Zn and 125 g of Ni. In the present example, the melting temperature was elevated as in Example 1, while adding Ni into the Zn melt, until the melt temperature of 850° C., which was directly below the boiling point of Zn, was obtained.

The Zn-4 wt % Ni alloy could be cast into a mold. In addition, alloy shot having a variable size could be produced by dropping the melt of this alloy into water. The Ni content of the cast product was 4 wt %, the balance being Zn.

Example 4

The Zn-Ni alloys melted in Examples 1–3 were atomized by the same atomizing method of Zn. The particle size became 1 mm or less.

Example 5

A Zn-13 wt % Ni alloy was produced by the same method as in Example 1 except for the flux, whose composition was 13.3 wt % NaCl, 16.7 wt % of KCl, and 70 wt % of $Na_2B_4O_7$ (melting point-approximately 700° C.). Ni could be uniformly alloyed.

Comparative Example 1

Melting of Zn-4 wt % Ni alloy was intended in this example. It was tried in this example to raise the temperature of melt to a level 100° C. higher than the melting point of Zn-4 wt % Ni alloy (approximately 700° C.). Oxidation of Zn on the melt surface started at approximately 600° C. Zn actively vaporized at a temperature higher than 750° C. and was ignited. The combustion of Zn was so vigorous that melting of Zn-4 wt % Ni alloy was impossible.

Comparative Example 2

KCl and NaCl were weighed at 50 g, respectively, and were mixed in a mortar. It was intended in this example to melt a Zn-4 wt % Ni alloy. When the melt temperature of this alloy was elevated to 450° C., 100 g of this flux was dispersed on the surface of melt. When melt temperature was elevated to-approximately 650° C., then, the flux covered the surface of melt. Melt temperature was further elevated to approximately 800° C. The flux could not absorb Zn oxide and Ni oxide, which were formed by partially oxidation of Zn and Ni during the temperature rise. The solid ZnO and NiO were therefore mixed in the flux melt. Since the alloy melt could not be thoroughly covered by the flux melt, Zn was actively vaporized and then ignited. Vigorous combustion of Zn thus occurred. Melting of a Zn-4 wt % Ni alloy was therefore not successful because of the phenomena described above.

Comparative Example 3

250 g of $Na_2B_4O_7$ and 650 g of $Na_2CO_3$ were weighed and were mixed in a mortar. It was intended in this example to melt a Zn-4 wt % Ni alloy. When the melt temperature of this alloy was elevated to 600° C. 100 g of this flux was dispersed on the surface of melt. When melt temperature was elevated to approximately 600° C., the flux was in a half molten state Since the melting point of this flux was approximately 800° C., Zn vaporized vigorously during a temperature elevation up to 750° C. An ignition phenomenon thus occurred. Melting of a Zn-4 wt % Ni alloy by using the flux consisting of $Na_2B_4O_7$ and $Na_2CO_3$ was therefore unsuccessful because of the combustion phenomenon as described above.

Examples 6–12

In these examples, a Zn-Ni plating bath of a conventional composition for high-speed plating with an insoluble anode, was prepared. The liquid, in which Zn and Ni sulfate ions were dissolved, and the dissolving condition was as follows.

1. Dissolving Liquid

| | |
|---|---|
| Basic Composition: | 220 g/l of $ZnSO_4.7H_2O$ ($Zn^{2+}$ ions-50 g/l)<br>224 g/l of $NiSO_4.6H_2O$ ($Ni^{2+}$ ions-50 g/l) |

2. Zn-Ni alloy Shape: shot or powder Composition: Zn-2–50 wt % Ni alloy
3. Testing method 50 g of the Zn-Ni alloy was charged into the liquid 1, which was contained in a beaker which was maintained at a temperature of 50° or 60° C. in a temperature-controlled bath. The dissolving amount of Zn and Ni was measured by analyzing the $Ni^{2+}$ and $Zn^{2+}$ concentrations in the liquid 1. Since pH changes during dissolving of Zn-Ni alloy, sulfuric acid was continuously added to maintain the initial value of pH. Furthermore, in order to revert to the initial pH value as soon as possible, the dissolving liquid was stirred at 250 rpm.

Example 6

The acidity was set at pH=0.8 under the conditions as described above. The bath temperature was 60° C. The Zn-13 wt % Ni alloy, which was crushed to a particle size of 43 μm or less, was dissolved in total amount, i.e., 50 g in 6 minutes as is shown in the FIGURE.

Example 7

The acidity (sulfuric acid) was set as pH=1.5 under the conditions as described above. The bath temperature was 60° C. The Zn-13 wt % Ni alloy, which was crushed to a particle size of 43 μm or less, was dissolved in total amount, i.e., 50 g in 15 minutes as is shown in the FIGURE. The results of dissolving test are shown in the FIGURE.

Example 8

The acidity was pH=1.5 under the conditions as described in Example 6. 50 g of Zn-13 wt % Ni alloy, whose particle diameter was 0.5 mm or less, was dissolved in total amount in dissolving time of 30 minutes.

Example 9

The acidity was pH=1.5 under the conditions as described above in Example 6. As is shown by curve 1-4 in the FIGURE, 25 g of Zn-13 wt % Ni alloy, whose particle diameter was 223 μm or less, was dissolved in total amount of dissolving time of 25 minutes.

Example 10

50 g of Zn-50 wt % Ni alloy, whose particle diameter was 43 μm or less, was dissolved under the same conditions as in Example 6. Virtually the total amount of the alloy was dissolved in 28 minutes, as is shown by curve 1-5 in the FIGURE.

Example 11

50 g of Zn-2 wt % Ni alloy, whose particle diameter was 43 μm or less, was dissolved under the same conditions as in Example 6. The total amount of the alloy was dissolved in 25 minutes, as is shown by curve 1-6 in the FIGURE.

Example 12

The acidity was pH=0.8 under the same conditions as in Example 6. Zn-2 wt % Ni alloy (particle diameter-1 mm), Zn-10 wt % Ni alloy (particle diameter-232 μm), Zn-25 wt % Ni alloy (particle diameter-43 μm), and Zn-50 wt % Ni alloy (particle diameter-5 μm) were dissolved. 50 g of each alloy was dissolved in 10 minutes.

Comparative Example 4

Zn-13 wt % Ni alloys having particle diameter of 2 mm and 7 mm were dissolved under the same conditions as in Example 6. The results are shown by 2-1 and 2-2 of the FIGURE. 17 g of 50 g of the alloy 2 mm in size was dissolved in 3 hours of dissolving time. 5 g of 50 g of the alloy 7 mm in size was dissolved for 3 hours of dissolving time. 33 g of the alloy 2 mm in size and 45 g of the alloy 7 mm in size therefore remained undissolved.

Comparative Example 5

Metallic Zn and metallic Ni, each 7 mm or less in particle size were dissolved under the same conditions as in Example 6. The Zn was dissolved in one test and the Ni was dissolved in the other test. 7 g of the metallic Zn and 0.03 g of the metallic Ni were dissolved in 3 hours of dissolving time. 43 g of Zn and 49.97 g of Ni therefore remained undissolved.

Comparative Example 6

Commercially available Zn and Ni powder were dissolved under the same conditions as in Example 6. Zn was dissolved in one test, and Ni was dissolved in the other test. As is shown by the curves 2-5 and 2-6 for the Zn and Ni powder, respectively, 16 g of Ni powder and 23 g of Ni powder were dissolved in 3 hours of dissolving time. Thus, 34 g of Zn powder and 27 g of Ni powder remained undissolved.

Comparative Example 7

Commercially available Zn and Ni powder were mixed to provide a Zn-13 wt % Ni composition. This mixture was dissolved under the same conditions as in Example 6. As is shown by curve 2-7, 37 g of the mixture was dissolved and 13 g remained undissolved, respectively, in 3 hours of dissolving time.

Example 13

Zn-15 wt % Ni alloy was melted by the method of Example 1 and was then crushed and sieved to provide the grain size as given in Table 1. A sample 13.3 g in weight was taken from this alloy and was dissolved together with the zinc metal (purest zinc-99.99 wt % of Zn) in an amount of 986.7 g by the mixing or stirring method given in Table 1. The melting temperature was 460° C.±10° C. The flux used was $NH_4Cl$. This $NH_4Cl$ flux and Zn-15% wt Ni alloy was mixed in a proportion of 1:0.5, except for Nos. 6 and 7 in Table 1 in which the proportion was 1:0.2.

TABLE 1

| | Dissolving Result of Zn-0.2% Ni | | | |
|---|---|---|---|---|
| Nos. | Dissolving Time (minutes) | Size of Zn—Ni Alloy | Stirring | Undissolved Amount (g) |
| 1* | 10 | 10–20 mm | 50 rpm | 5.50 |
| 2* | 10 | 10 mm | manual stirring | 6.84 |
| 3* | 10 | 5 mm | manual stirring | 3.84 |
| 4 | 10 | 44 microns | manual stirring | none |
| 5* | 10 | 10–20 mm | manual stirring | 8.88 |
| 6 | 25 | 10–20 mm | 100 rpm | none |
| 7 | 35 | 10–20 mm | manual stirring | none |
| 8 | 44 | 10–20 mm | manual stirring | none |

The asterisked* Nos. are comparative examples, in which the dissolving time is short. It is clear that the charged materials in the size range of from 10 to 20 mm could be completely dissolved by means of stirring. Charged materials with the particle size of 44 microns or less could be completely dissolved even in dissolving time of 10 minutes.

Chemical analysis of the obtained ingots of Zn-0.2 wt % Ni alloy to determine Ni content was carried out by sampling several portions in longitudinal and lateral directions. The difference between the largest and smallest Ni contents was 0.03 wt % at the highest. It was therefore recognized that Ni was dissolved uniformly. Also, no segregation of Ni was confirmed by an optical microscope-observation.

We claim:

1. A method for supplying $Ni^{2+}$ and $Zn^{2+}$ ions into an acidic electroplating bath by using a Zn-Ni alloy, comprising supplying simultaneously $Zn^{2+}$ and $Ni^{2+}$ ions to an acidic electroplating bath for plating a Zn-Ni alloy layer consisting essentially of Zn and Ni, by chemical dissolution of Zn-Ni alloy particles wherein said alloy particles have a particle diameter of 1 mm or less and comprise 2 to 50% by weight of Ni, the balance being essentially Zn.

2. The method according to claim 1, wherein said alloy comprises from 10 to 30% by weight of Ni.

3. The method according to claim 1, wherein said alloy particles are produced by using a flux comprising a fused-salt former, which forms a salt having a melting temperature of 700° C. or less, and $Na_2B_4O_7$.

4. The method according to claim 3, wherein said flux further comprises $Na_2CO_3$.

* * * * *